United States Patent [19]

Legierse et al.

[11] Patent Number: 4,964,958

[45] Date of Patent: Oct. 23, 1990

[54] METHOD OF PRODUCING A METAL MATRIX

[75] Inventors: Petrus E. J. Legierse, Nuenen, Netherlands; Louis J. M. Beckers, Overpelt, Belgium; Jeroen F. M. Landsbergen, Best, both of Netherlands

[73] Assignee: Philips & Du Pont Optical Company, New York, N.Y.

[21] Appl. No.: 412,971

[22] Filed: Sep. 26, 1989

[30] Foreign Application Priority Data

Oct. 14, 1988 [NL] Netherlands ..... 8802533

[51] Int. Cl.[5] ..... C25D 1/10

[52] U.S. Cl. ..... 204/5

[58] Field of Search ..... 204/5

[56] References Cited

U.S. PATENT DOCUMENTS 4,297,312 10/1981 Carroll ..... 264/134

*Primary Examiner*—T. M. Tufariello

*Attorney, Agent, or Firm*—Norman N. Spain

[57] ABSTRACT

Method of producing a metal matrix for the manufacture of optically readable information carriers, in which a photoresist layer which contains an information track and is provided on a carrier is coated with an electroless gold layer, the gold layer at the side provided with the resist layer being exclusively in contact with organic material, the gold layer being provided with a first metal peel by electro-deposition, the carrier coated with the resist layer is removed, the gold layer-coated first metal peel provided by electro-deposition at the side having the gold layer with a second metal peel, the first metal peel being removed together with the gold layer and optionally a further metal copy of the second metal peel is produced by electro-deposition.

5 Claims, 1 Drawing Sheet

METHOD OF PRODUCING A METAL MATRIX

BACKGROUND OF THE INVENTION

The invention relates to a method of producing a metal matrix which can be used in the manufacture of optically readable synthetic resin information carriers.

Such a method is, for example, disclosed in Applicants United Kingdom Patent Specification No. 2,128,206 (PHN 10,790). In said prior art procedure the starting point is a master disc having a preferably glass substrate and a photoresist layer in which an optically readable information track is provided. At the side carrying the photoresist layer the master disc is coated with a layer of silver which is applied electrolessly, for example by means of a vapour deposition process, a sputtering process or a chemical plating process. On top of this layer a metal peel, for example a nickel peel, is applied by means of electro-plating. The master disc is thereafter removed. The metal copy obtained which contains the silver layer is denoted the father matrix. Consequently, the father matrix is provided with a (negative) impression of the information track present in the master disc. By means of an electro-plating process a further metal copy (or replica), the what is commonly referred to as the mother disc is produced from the father matrix. For that purpose the silver layer is usually first removed from the father matrix with an oxidising agent, and the exposed nickel surface is passivated by treatment in an alkaline medium. This achieves that the mother disc can easily be removed from the father matrix. The mother disc has a positive impression of the information track present in the master disc. After its surface has been passivated, the what are commonly denoted son matrices can be produced from the mother disc by means of electro-deposition, which are used as dies in the process for the manufacture of synthetic resin information carriers. A suitable procedure is an injection moulding or injection pressing procedure. The synthetic resin information carriers obtained, such as compact disc (T.M.) or laser vision (T.M.) have an optical information track which is a positive impression of the information track of the master disc.

The prior art method described in the foregoing has the disadvantage that the quality of the master disc coated with a silver layer deteriorates or its durability is limited. The silver is easily attacked by the atmosphere, sulphides then being formed. This implies that the finished master disc must be further treated directly or very soon into a die.

SUMMARY OF THE INVENTION

The invention has for its object to provide a method in which the master disc used retains its originally good quality, and has a long shelf life. This provides the advantage that the finished master disc need not be directly or very soon be further processed. No additional measures are required to protect the master disc from atmospheric contamination. This promotes the marketing of master discs.

According to the invention, the advantage outlined above is achieved by means of a method described in the opening paragraph which is characterized, in that a master disc having a substrate and a photoresist layer provided thereon, which has an optically readable information track, is provided at the side having the photoresist layer with an electrolessly deposited gold layer, the gold layer at the side having the resist layer being exclusively in contact with organic material, a metal peel is applied by electro-deposition on the gold layer, the master disc is separated and thereafter the metal peel obtained which contains the gold layer is provided at the side coated with the gold layer with a second metal peel whereafter the first metal peel together with the gold layer is separated and optionally a further metal copy of the second metal peel is made by electro-deposition.

The gold layer used under the method is not attacked in atmospheric conditions, so that the gold layer-plated master disc can be transported and stored without the need of special protective measures. A problem is, however, that gold is such a noble metal that passivation is not readily possible. In this connection it should be noted that the United Kingdom Patent Specification No. 638,006 teaches that a gold plate can be passivated by treating it with a highly oxidising agent such as a permanganate or a dichromate. However, when this method is applied to the above-described, gold-plated master disc, good results were not obtained. It must be taken into consideration that the optically readable information track provided in the master disc has a very finely detailed structure of information bits of having lengths from one to a few microns and a depth of, for example, 0.2 $\mu$m. If the gold layer is not passivated to an optimum extent, the very small quantities of gold settling on the impression, will change the fine information track in an unacceptable manner so that the stored information can no longer be read.

Applicants have experimented with a customary master disc in which the pits (bits) of the information track provided in the photoresist extend to as far as the glass substrate. After electro-deposition of the gold layer it is galvanically re-enforced with a Ni-layer and the father disc obtained is separated from the master. It has been found that on making a metal copy, the mother disc, from this father disc traces of gold remain behind on the mother disc, originating from those portions of the gold layer which were in contact with the glass substrate disc of the master.

In accordance with the method of the invention, a perfectly passivated gold layer surface is obtained. This is achieved by the gold layer, at the side provided with the photoresist, coming into contact enclosing with organic material. The cause of the passivation is not known. It is presumed that the organic material or the volatile components such as residual monomers present in the organic material, for example a synthetic resin, diffuse to some extent into the gold surface.

DETAILED DESCRIPTION OF THE INVENTION

The gold layer is applied by means of an electroless, consequently currentless, process. A suitable process is more specifically a vapour deposition procedure or a sputtering procedure. The thickness of a gold layer is very small and, typically, amounts to some hundreds of Angstroms. After the gold layer has been deposited, the gold layer is reinforced by electro-deposition with a metal peel, more specifically a Ni peel. Thereafter the resist layer is dissolved in an alkaline medium, so that a father matrix is obtained having a Ni peel coated with a gold layer. The optical information track is copied into the surface of Ni peel. Consequently this track is the negative of the information track provided in the master disc.

By means of electro-deposition, a metal copy, the mother disc, is produced from the father disc obtained. For that purpose a metal layer, for example a Ni layer, is made to grow on the gold layer in an electro-deposition bath, for example a nickel sulphamate bath. The gold layer is used as the cathode in this procedure. After the Ni layer is sufficiently thick, for example some hundreds of microns, the electro-deposition procedure is stopped. The deposited Ni peel is removed from the father disc. The gold layer passivated in accordance with the invention is the interface layer. The separation is perfect, not gold residue being present on the mother disc. Optionally one or more metal copies, for example Ni copies, are made from the mother disc. For that purpose the surface of the mother disc containing the information track is first passivated with, for example, hydrogen peroxide. A very thin monomolecular layer of nickel oxide is formed. Thereafter a metal peel, for example preferably a Ni peel is grown by means of electro-deposition on the passivated surface. After separation of the mother disc a son matrix is obtained whose information track is a negative impression of the information track provided in the master disc. This son matrix is used in an injection moulding or injection pressing process for the manufacture of synthetic resin information carriers the information track of which is a positive impression of the information track of the master disc.

The synthetic resin information carriers obtained are metal-plated at the side provided with the information track and can be read optically, in the reflection mode, using laser light.

In an advantageous embodiment of the method according to the invention, a master disc is used which has a glass substrate plate, an intermediate layer of organic material having been provided between the substrate and the photo-resist layer.

A very suitable material for the intermediate layer is a synthetic resin, such as polymethylmethacrylate.

Also the use of an intermediate layer of a polymerized photoresist is very suitable.

Figure 1:
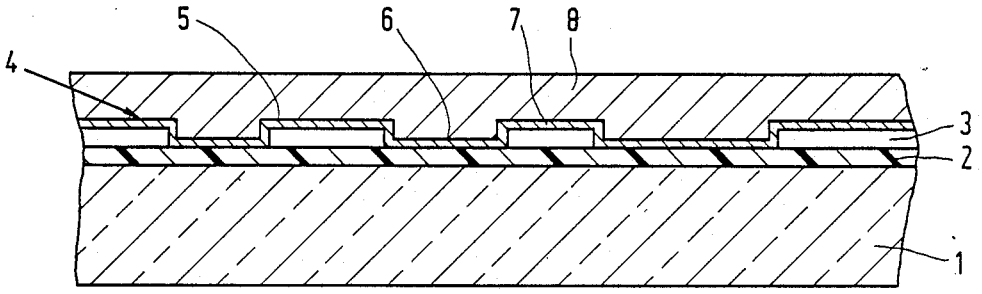
FIG. 1 is a cross-sectional view of a portion of a master disc further disc combination used in the method of the invention.
Figure 2:
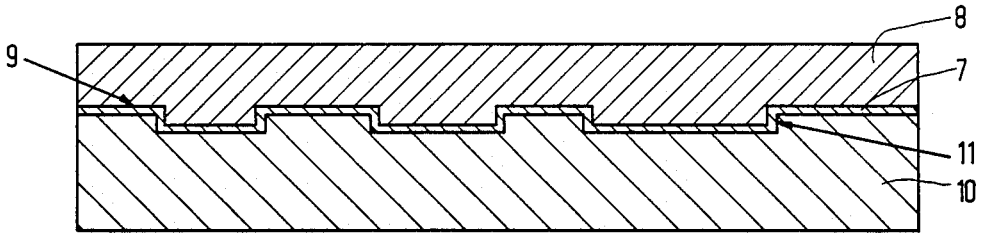
FIG. 2 is a cross-sectional view of a portion of a father disc-mother disc combination used in the method of the invention.

The invention will now be described by way of example in greater detail with reference to an embodiment and the accompanying drawings wherein FIG. 1 is a cross-sectional view of a portion of a master disc-father disc combination, used in the method of the invention and FIG. 2 is a cross-sectional view of a portion of a father disc-mother disc combination, used in the method of the invention.

In FIG. 1, reference numeral 1 denotes a 5 mm thick glass plate having a diameter of 240 mm and a polished surface. The polished surface of glass plate 1 is provided with a photo-resist layer 2 which is polymerized by, for example, exposure to light. Instead of a cured photoresist layer an intermediate layer 2 of a different organic material can alternatively be provided, for example a layer of a plastic synthetic resin, for example polymethylmethacrylate, or a layer of synthetic resin which is cross-linked with heat or light, such as a U.V. light-cured layer of acrylate or methacrylate monomers. The substrate 1 and also the layer 2 can alternatively both be made of synthetic resin. This may be the same synthetic resin.

Layer 2 is provided with a layer 3 of a positive photoresist having a thickness of 0.12 μm. The photoresist used is derived from naphthoquinone diazide which is marketed as Hunt Waycoat type HPR204. The resist layer is exposed to pulsed laser light modulated in accordance with the information to be inscribed. The resist layer thus exposed to light in accordance with a pattern is developed in a solution of 10 g NaOH and 50.5 g $Na_4P_2O_7.10\ H_2O$ in 4.5 litres of water. This causes the exposed portions of the photoresist layer to be dissolved and a helical information track 4 is obtained which has a crannelated profile of information areas 5 situated at a higher level alternating with information areas 6 situated at a lower level in the resist layer.

The longitudinal dimensions of the information areas vary from approximately 0.2 to 3 μm according to the stored information. The difference in height between the information area levels is approximately 0.1 μm. The areas are optically readable. A gold layer 7 having a thickness of 0.1 μm is vapour-deposited on the developed photoresist layer 3.

Thereafter a nickel layer 8 (with a thickness of 400 μm) is provided by electro-deposition on the gold layer 7. The metal peel 7, 8 is now mechanically separated from the glass plate 1. The residues of resist layer 3 and/or intermediate layer 2 still present on the metal peel 7, 8 are removed by treatment in an oxidizing, alkaline medium, such as an aqueous solution of NaOH and $H_2O_2$. The metal peel 7, 8 obtained is also called the father disc. The information track 4 of the master disc is duplicated in this peel. The information track 9 (FIG. 2) impressed in peel 7, 8 is consequently the negative image of information track 4 of the master disc 1, 2, 3.

Without any further treatment or, optionally, after treatment with an oxidizing agent, the father disc 7, 8 (FIG. 2) is provided with a nickel peel 10 by electro-deposition at the side provided with the gold layer 7. Nickel peel 10 is removed mechanically. The separation is effected on gold layer 7, gold layer 7 remaining connected to nickel layer 8.

Surprisingly, a perfect separation is obtained, gold residue remaining behind on the nickel layer 10. This means that the gold layer 7 is excellently passivated. The nickel peel 10 obtained, alternatively denoted the mother disc, has an information track 11 which is an impression of the information track 9 of the father disc 7, 8. The information track 11 is consequently a positive copy of the information track 4 of the master disc 1, 2, 3.

If so desired, further metal copies, the son matrices, can be produced by means of electro-deposition from the mother disc 10. For that purpose the surface of the mother disc 10 must first be passivated at the side provided with the information track 11. This is effected by treating the surface with an aqueous solution of $K_2Cr_2O_7$. On the surface thus passivated the nickel peel is deposited which after removal of the mother disc, constitutes a son matrix. Using this matrix it is possible to produce, for example in an injection moulding process, synthetic resin information carriers whose information track is a positive impression of the information track of the master disc. The plastic information carriers obtained are finally provided with a metal layer, for example a vapour-deposited Al layer at the side having the information track. If so desired the plastic information carrier may alternatively be provided with an optical recording layer.

In comparative experiments, Applicants have produced a master disc and a father disc in a manner corresponding to the manner described in the foregoing, however with the difference that no intermediate layer 2 (FIG. 1) was used and consequently photoresist layer 3 bears against the glass plate 1. It was found that a father disc (7, 8) can be produced without any serious problems. However, when a metal copy (mother disc) of the father disc is made things went wrong. The gold layer 7 of the father disc (7, 8) is first treated with an aqueous solution of $K_2Cr_2O_7$. Thereafter, a nickel peel is provided in an electro-deposition method. The nickel peel (mother disc) cannot be perfectly separated from the father disc. It was found that after separation, gold residues are present on the separated Ni-peel (mother disc). As a result thereof the information track of the mother disc and also of the father disc is deformed, so that the plates are useless for further treatment.

We claim:

1. A method of producing a metal matrix which can be used in the manufacture of optically readable synthetic resin information carriers, characterized in that a master disc having a substrate and a photoresist layer provided thereon and which has an optically readable information track, is provided at the side having the photoresist layer with an electrolessly deposited gold layer, the gold layer at the side having the resist layer being exclusively in contact with organic material, a first metal peel is applied by electro-deposition on the gold layer, the master disc is separated and thereafter the first metal peel obtained which contains the gold layer is provided at the side coated with the gold layer with a second metal peel, whereafter the first metal peel together with the gold layer is separated.

2. A method as claimed in claim 1, characterized in that the master disc used includes a glass substrate plate, an intermediate layer of organic material being provided between the substrate and the photoresist layer.

3. A method as claimed in claim 2, characterized in that the intermediate layer is a layer of polymerized photoresist.

4. A method as claimed in claim 2, characterized in that the intermediate layer is a synthetic resin layer.

5. The method of claim 1 in which a metal impression of the second metal peel is made by electro-deposition.

* * * * *